US010336089B2

(12) United States Patent
Ghozeil et al.

(10) Patent No.: US 10,336,089 B2
(45) Date of Patent: Jul. 2, 2019

(54) PRINTHEADS WITH SENSOR PLATE IMPEDANCE MEASUREMENT

(71) Applicant: Hewlett-Packard Development Company, L.P., Houston, TX (US)

(72) Inventors: Adam L. Ghozeil, Corvallis, OR (US); Scott A. Linn, Corvallis, OR (US); David Maxfield, Corvallis, OR (US); Andrew Van Brocklin, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/940,954

(22) Filed: Mar. 29, 2018

(65) Prior Publication Data

US 2018/0297370 A1 Oct. 18, 2018

Related U.S. Application Data

(63) Continuation of application No. 15/113,384, filed as application No. PCT/US2014/013796 on Jan. 30, 2014, now Pat. No. 9,962,949.

(51) Int. Cl.
*B41J 2/175* (2006.01)
*B41J 2/14* (2006.01)

(52) U.S. Cl.
CPC ..... *B41J 2/17566* (2013.01); *B41J 2/1404* (2013.01); *B41J 2002/14354* (2013.01); *B41J 2002/17579* (2013.01)

(58) Field of Classification Search
CPC ..... B41J 2/17566; B41J 2/1404
See application file for complete search history.

(56) References Cited

U.S. PATENT DOCUMENTS

| | | | |
|---|---|---|---|
| 5,721,574 | A | 2/1998 | Kubby |
| 6,084,605 | A | 7/2000 | Yaji |
| 6,257,694 | B1 | 7/2001 | Tokumaru et al. |
| 6,874,861 | B2 | 4/2005 | Farr et al. |
| 8,136,905 | B2 | 3/2012 | Kneezel et al. |
| 8,336,981 | B2 | 12/2012 | Chen et al. |
| 2004/0223021 | A1 | 11/2004 | Farr et al. |
| 2005/0001863 | A1 | 1/2005 | Farr et al. |
| 2005/0231545 | A1* | 10/2005 | Benjamin ..... B41J 2/17546 347/19 |

(Continued)

FOREIGN PATENT DOCUMENTS

| | | |
|---|---|---|
| EP | 1493586 | 1/2005 |
| JP | S62-015415 | 1/1987 |
| JP | 2001-232814 | 8/2001 |

(Continued)

OTHER PUBLICATIONS

Tseng et al.; A Novel Microinjector and Virtual Chamber Neck; IEEE; Jan. 25-29, 1998; pp. 57-62.

*Primary Examiner* — Jason S Uhlenhake
(74) *Attorney, Agent, or Firm* — HP Inc. Patent Department

(57) ABSTRACT

In an implementation, a printhead includes a nozzle and a fluid channel. A sensor plate is located within the fluid channel. An impedance measurement circuit is coupled to the sensor plate to measure impedance of fluid within the channel during a fluid movement event that moves fluid past the sensor plate.

4 Claims, 12 Drawing Sheets

(56) References Cited

U.S. PATENT DOCUMENTS

| | | | |
|---|---|---|---|
| 2011/0084997 | A1 | 4/2011 | Chen et al. |
| 2013/0278657 | A1 | 10/2013 | Martin et al. |

FOREIGN PATENT DOCUMENTS

| | | | |
|---|---|---|---|
| JP | 2012-096363 | | 5/2012 |
| JP | 2012106410 | | 6/2012 |
| JP | 2012192646 | | 10/2012 |
| WO | WO-2013-062513 | A1 | 5/2013 |

* cited by examiner

PRINTHEADS WITH SENSOR PLATE IMPEDANCE MEASUREMENT

CROSS REFERENCE TO RELATED APPLICATIONS

This application is a continuation of U.S. application Ser. No. 15/113,384, filed Jul. 21, 2016, which is a 371 application of PCT Application No. PCT/US2014/013796, filed on Jan. 30, 2014. The contents of both U.S. application Ser. No. 15/113,384 and PCT Application No. PCT/US2014/013796 are incorporated herein by reference in their entirety.

BACKGROUND

Accurate ink level sensing in ink supply reservoirs for various types of inkjet printers is desirable for a number of reasons. For example, sensing the correct level of ink and providing a corresponding indication of the amount of ink left in a fluid cartridge allows printer users to prepare to replace depleted ink cartridges. Accurate ink level indications also help to avoid wasting ink, since inaccurate ink level indications often result in the premature replacement of ink cartridges that still contain ink. In addition, printing systems can use ink level sensing to trigger certain actions that help prevent low quality prints that might result from inadequate supply levels.

While there are a number of techniques available for determining the level of fluid in a reservoir, or a fluidic chamber, various challenges remain related to their accuracy and cost.

BRIEF DESCRIPTION OF THE DRAWINGS

The present embodiments will now be described, by way of example, with reference to the accompanying drawings, in which.

DETAILED DESCRIPTION

Overview

Figure 1:
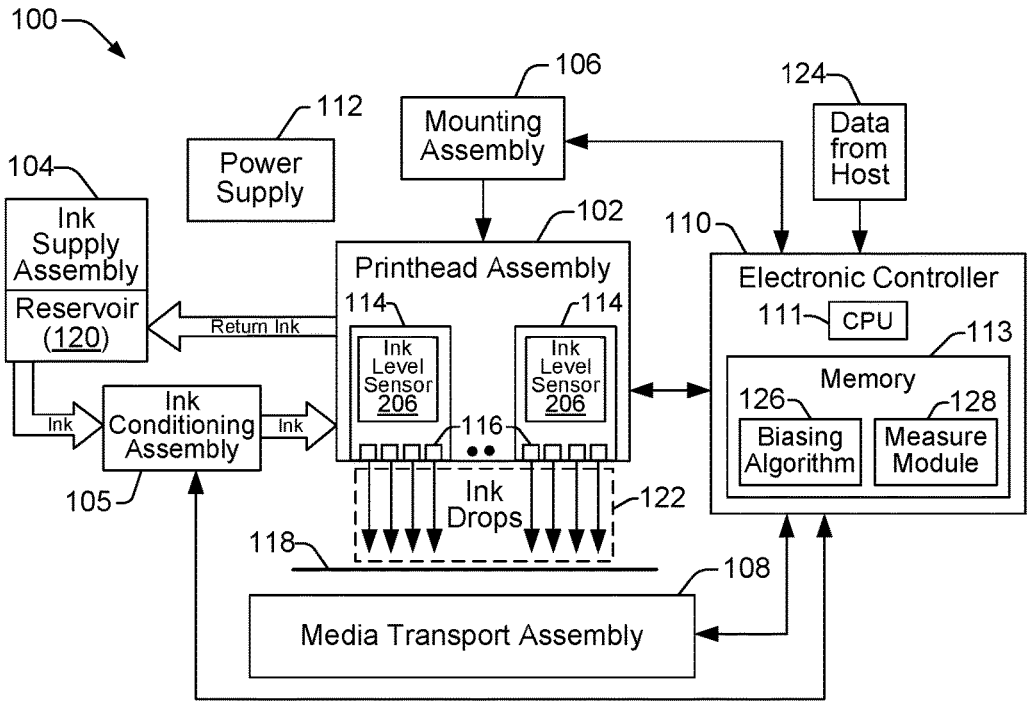
FIG. 1 shows an example of an inkjet printing system suitable for implementing a fluid ejection device having a fluid level sensor that measures the impedance of a sensor plate.

As noted above, there are a number of techniques available for determining the level of fluid in a reservoir or fluidic chamber. For example, prisms have been used to reflect or refract light beams within ink cartridges to generate electrical and/or user-viewable ink level indications. Backpressure indicators are another way to determine fluid levels in a reservoir. Some printing systems count the number of drops ejected from inkjet print cartridges as a way of determining ink levels. Still other techniques use the electrical conductivity of the fluid as a level indicator in printing systems. Challenges remain, however, regarding improving the accuracy and cost of fluid level sensing systems and techniques.

Example printheads discussed herein provide fluid/ink level sensors that improve on prior ink level sensing techniques. A printhead fluid/ink level sensor generally incorporates one or more fluidic elements of the printhead MEMS structure with an impedance measurement/sensor circuit. The fluidic elements of the MEMS structure include a fluidic channel that acts as a type of test chamber. The fluidic channel has an ink level that corresponds with the availability of ink in an ink reservoir. A circuit includes one or more sensors (i.e., sensor plates) located within the channel, and it measures the level or presence of ink in the channel by measuring the impedance of the ink in the channel from a sensor plate to a ground return. Because the impedance of the ink will be much lower than that of air, the impedance measurement circuit detects if ink is no longer in contact with the sensor. The impedance measurement circuit also detects if a small film of residual ink remains on the sensor. The impedance rises as the cross section of the residual film decreases. A biasing algorithm executes on a printing system to bias the circuit at an optimum operating point. The operating point at which the circuit is biased enables a maximum output difference signal between a dry ink condition (i.e., no ink present) and a wet ink condition (i.e., ink present). Different fluid movement events, such as the ejection/firing of ink drops from a printhead nozzle and the priming of the printhead with ink, exert backpressure on the ink within the fluidic channel. The backpressure retracts the ink from the nozzle and can pull it back through the channel over the sensor plate, exposing the plate to air and causing measureable variations in the plate impedance. The impedance measurement/sensor circuit can be implemented, for example, as a controlled voltage source that induces a measureable current through the plate, or a controlled current source whose current induces a voltage response across the plate.

When implementing a controlled voltage source within the impedance measurement circuit, a current induced through the sensor plate is measured through a sense resistor to provide an indication of whether the plate is wet (i.e., indicating ink is present in the fluidic channel) or dry (i.e., indicating air is present in the fluidic channel). The biasing algorithm executes to bias the voltage source at an optimum point that induces a maximum differential current response through the sensor plate (and sense resistor) between the wet and dry plate conditions in weak signal conditions. When implementing a controlled current source within the impedance measurement circuit, a voltage induced across the plate provides a similar indication of whether the plate is wet or dry. The biasing algorithm executes to bias the current source at an optimum point where the amount of current supplied to the sensor plate induces a maximum differential voltage response across the plate between the wet and dry plate conditions in weak signal conditions.

The disclosed printhead and impedance measurement/sensing circuit enable a fluid level sensor having advantages that include a high tolerance to contamination from debris left behind in the MEMS structure (e.g., fluidic channels and ink chambers). The high tolerance to contamination helps provide accurate fluid level indications between wet and dry conditions. The cost of the fluid level sensor is also controlled because of its use of circuitry and MEMS structures that are placed onto an existing thermal ink jet print head. The size of the impedance measurement/sensing circuitry is such that it can be placed in the space of a few ink-jet nozzles.

In one example, a printhead includes a nozzle, a fluid channel, and a sensor plate located within the fluid channel. The printhead also includes an impedance measurement circuit coupled to the sensor plate to measure impedance of fluid within the channel during a fluid movement event that moves fluid past the sensor plate.

In another example, a printhead includes a fluid channel that fluidically couples a nozzle with a fluid supply slot. An impedance measurement circuit integrated on the printhead includes a sensor plate located within the channel and a controlled voltage source to induce a current through the sensor plate and a sense resistor. A sample and hold amplifier in the impedance measurement circuit measures and holds a value of the current value induced through the sense resistor during a fluid movement event, such as an ink drop ejection or an ink priming event.

Illustrative Embodiments

FIG. 1 illustrates an example of an inkjet printing system 100 suitable for implementing a fluid ejection device having a fluid level sensor that measures the impedance of a sensor plate. In this example, a fluid ejection device is disclosed as an inkjet printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In some examples, ink supply assembly 104 supplies ink under positive pressure through an ink conditioning assembly 105 (e.g., for ink filtering, pre-heating, pressure surge absorption, degassing) to inkjet printhead assembly 102 via an interface connection, such as a supply tube. Thus, ink supply assembly 104 may also include one or more pumps and pressure regulators (not shown). Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between approximately negative 1" and approximately negative 10" of H2O. However, as the ink supply (e.g., in reservoir 120) nears its end of life, the backpressure exerted during printing (i.e., ink drop ejections) or priming operations increases. The increased backpressure is strong enough to retract the ink meniscus away from the nozzle 116 and move it back through the fluidic channel of the MEMS structure. An ink level sensor 206 (FIG. 2) on printhead 114 includes an impedance measurement/sensor circuit that provides an accurate ink level indication during such fluid movement events.

In some examples, reservoir 120 can include multiple reservoirs that supply other suitable fluids used in a printing process, such as different colors or ink, pre-treatment compositions, fixers, and so on. In some examples, the fluid in a reservoir can be a fluid other than a printing fluid. In one example, printhead assembly 102 and ink supply assembly 104 are housed together in an inkjet cartridge or pen (not shown). An inkjet cartridge may contain its own fluid supply within the cartridge body, or it may receive fluid from an external supply such as a fluid reservoir 120 connected to the cartridge through a tube, for example. Inkjet cartridges containing their own fluid supplies are generally disposable once the fluid supply is depleted.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one example, inkjet printhead assembly 102 is a scanning type printhead assembly. As such, mounting assembly 106 includes a carriage for moving inkjet printhead assembly 102 relative to media transport assembly 108 to scan print media 118. In another example, inkjet printhead assembly 102 is a non-scanning type printhead assembly. As such, mounting assembly 106 fixes inkjet printhead assembly 102 at a prescribed position relative to media transport assembly 108 while media transport assembly 108 positions print media 118 relative to inkjet printhead assembly 102.

Electronic printer controller 110 typically includes a processor (CPU) 111, firmware, software, one or more memory components 113, including volatile and non-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Data 124 represents, for example, a document and/or file to be printed. As such, data 124 forms a print job for inkjet printing system 100 and includes one or more print job commands and/or command parameters.

In one implementation, electronic printer controller 110 controls inkjet printhead assembly 102 to eject ink drops from nozzles 116. Thus, electronic controller 110 defines a pattern of ejected ink drops that form characters, symbols, and/or other graphics or images on print media 118. The pattern of ejected ink drops is determined by print job commands and/or command parameters from data 124. In one example, electronic controller 110 includes a biasing algorithm 126 in memory 113 having instructions executable on processor 111. The biasing algorithm 126 executes to control the ink level sensor 206 (FIG. 2) and to determine an optimum operating/bias point that produces a maximum voltage response difference from the sensor 206 between a wet condition (i.e., when ink is present) and a dry condition (when air is present). Electronic controller 110 additionally includes a measurement module 128 in memory 113 having instructions executable on processor 111. After an optimum bias point is determined, measurement module 128 executes to initiate a measurement cycle that controls the ink level sensor 206 and determines an ink level based on a measured time period during which a dry condition persists within a fluidic channel of the MEMS structure.

In the described examples, inkjet printing system 100 is a drop-on-demand thermal inkjet printing system with a thermal inkjet (TIJ) printhead 114 suitable for implementing an ink level sensor as disclosed herein. In one implementation, inkjet printhead assembly 102 includes a single TIJ printhead 114. In another implementation, inkjet printhead assembly 102 includes a wide array of TIJ printheads 114. While the fabrication processes associated with TIJ printheads are well suited to the integration of the disclosed ink level sensor, other printhead types such as a piezoelectric printhead can also implement such an ink level sensor. Thus, the disclosed ink level sensor is not limited to implementation within a TIJ printhead 114, but is also suitable for use within other fluid ejection devices such as a piezoelectric printhead.

Figure 2:
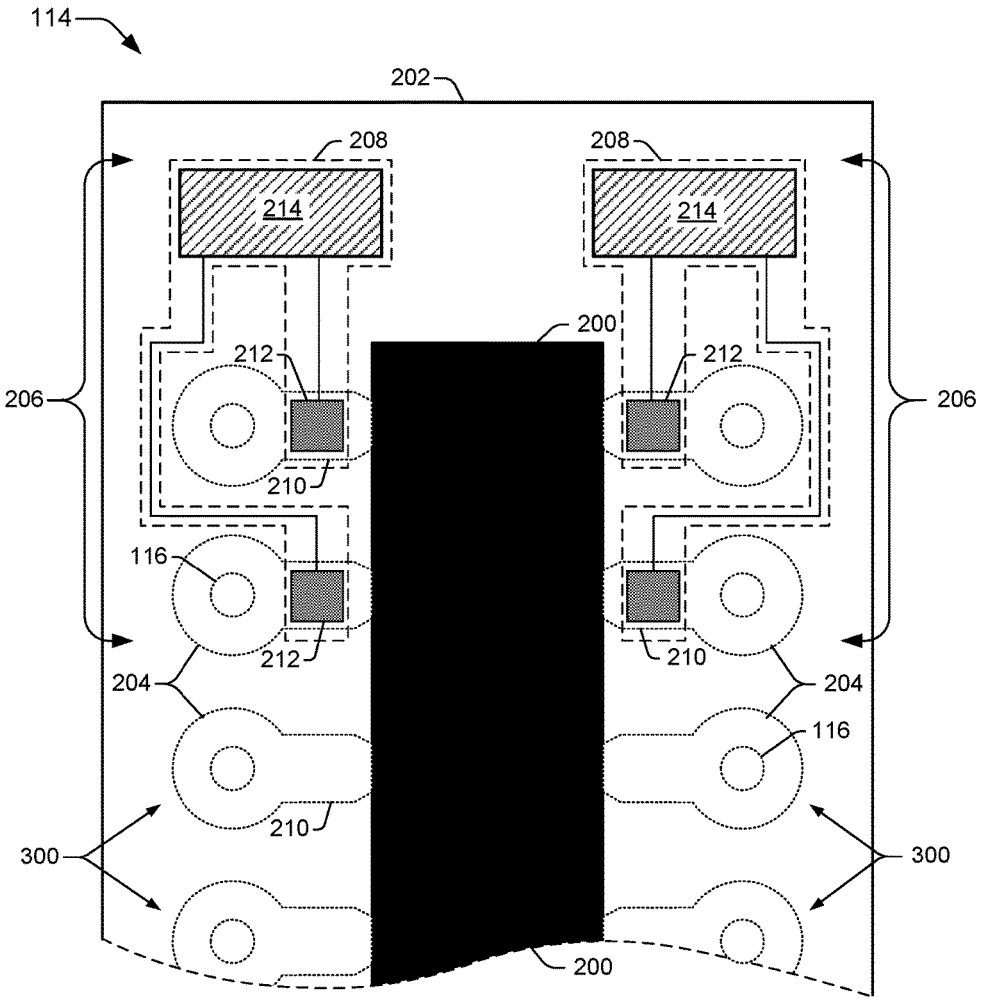
FIG. 2 shows a bottom view of one end of an example TIJ printhead having a single fluid slot formed in a silicon die substrate.

FIG. 2 shows a bottom view of one end of an example TIJ printhead 114 that has a single fluid/ink supply slot 200 formed in a silicon die substrate 202. Although printhead 114 is shown with a single fluid slot 200, the principles discussed herein are not limited in their application to a printhead with just one slot 200. Rather, other printhead configurations are also possible, such as printheads with two or more fluid slots, or printheads that use various sized holes to bring ink to fluidic channels and chambers. The fluid slot 200 is an elongated slot formed in the substrate 202 that is in fluid communication with a fluid supply, such as a fluid reservoir 120. Fluid slot 200 has fluid drop generators 300 arranged along both sides of the slot that include fluid chambers 204 and nozzles 116. Substrate 202 underlies a chamber layer having fluid chambers 204 and a nozzle layer having nozzles 116 formed therein, as discussed below with respect to FIG. 3. However, for the purpose of illustration, the chamber layer and nozzle layer in FIG. 2 are assumed to be transparent in order to show the underlying substrate 202. Therefore, chambers 204 and nozzles 116 in FIG. 2 are illustrated using dashed lines.

In addition to drop generators 300 arranged along the sides of the slot 200, the TIJ printhead 114 includes one or more fluid (ink) level sensors 206. A fluid level sensor 206 generally incorporates one or more elements of the MEMS structure on the printhead 114 and an impedance measurement/sensor circuit 208. A MEMS structure includes, for example, fluid slot 200, fluidic channels 210, fluid chambers 204 and nozzles 116.

An impedance measurement/sensor circuit 208 includes a sensor plate 212 located within a fluidic channel 210, such as on the floor or on a wall of a fluidic channel 210. The impedance measurement/sensor circuit 208 also incorporates other circuitry 214 that generally includes source components 504 (FIG. 5) to induce an impedance in the sensor plate 212 and sensing components to measure impedance. In different implementations, source components can include a voltage source and a current source. Sensing components can include, for example, buffer amplifiers, sample and hold amplifiers, a DAC (digital-to-analog converter), an ADC (analog-to-digital converter), and other measurement circuitry. The sensor plate 212 is a metal plate formed, for example, of tantalum. Portions of the other circuitry 214, such as the ADC and measurement circuitry, may not all be in one location on substrate 202, but instead may be distributed on substrate 202 in different locations. The fluid sensor 206 and impedance measurement/sensor circuit 208 are discussed in greater detail below with respect to FIGS. 5 through 13.

Figure 3:
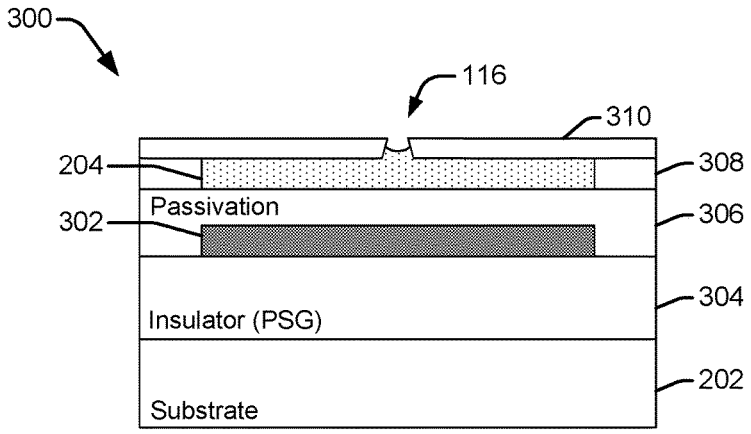
FIG. 3 shows a cross-sectional view of an example fluid drop generator.

FIG. 3 shows a cross-sectional view of an example fluid drop generator 300. Each drop generator 300 includes a nozzle 116, a fluid chamber 204, and a firing element 302 disposed within the fluid chamber 204. Nozzles 116 are formed in nozzle layer 310 and are generally arranged to form nozzle columns along the sides of the fluid slot 200. Firing element 302 is a thermal resistor formed of a metal plate (e.g., tantalum-aluminum, TaAl) on an insulating layer 304 (e.g., phosphosilicate glass, PSG) on the top surface of the silicon substrate 202. A passivation layer 306 over the firing element 302 protects the firing element from ink in chamber 204 and acts as a mechanical passivation or protective cavitation barrier structure to absorb the shock of collapsing vapor bubbles. A chamber layer 308 has walls and chambers 204 that separate the substrate 202 from the nozzle layer 310.

During printing, a fluid drop is ejected from a chamber 204 through a corresponding nozzle 116, and the chamber 204 is then refilled with fluid circulating from fluid slot 200. More specifically, an electric current is passed through a resistor firing element 302 resulting in rapid heating of the element. A thin layer of fluid adjacent to the passivation layer 306 that covers firing element 302 is superheated and vaporizes, creating a vapor bubble in the corresponding firing chamber 204. The rapidly expanding vapor bubble forces a fluid drop out of the corresponding nozzle 116. When the heating element cools, the vapor bubble quickly collapses, drawing more fluid from fluid slot 200 into the firing chamber 204 in preparation for ejecting another drop from the nozzle 116.

Figures 4A, 4B, 4C:
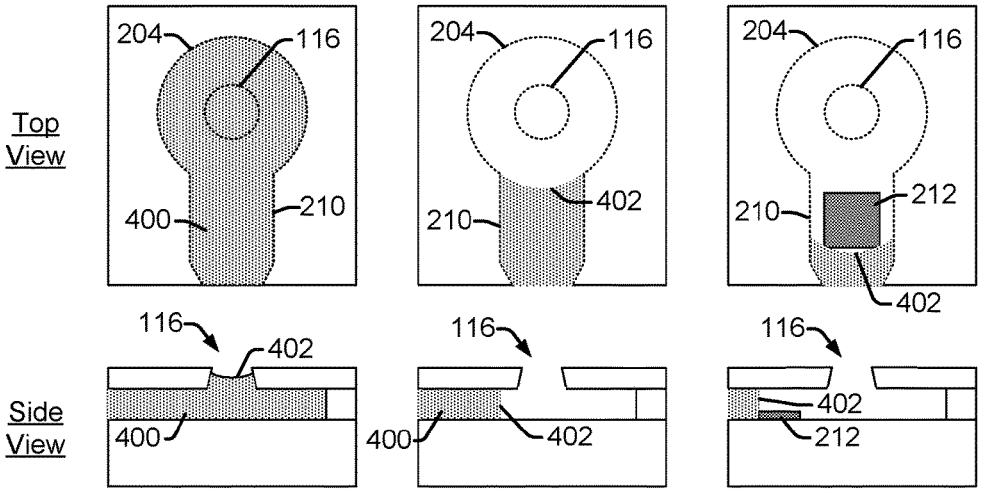
FIG. 4A shows partial top and side views of an example MEMS structure where ink fills a chamber and forms an ink meniscus within a nozzle.
FIG. 4B shows partial top and side views of an example MEMS structure where backpressure exerted on ink in a fluidic channel retracts the ink meniscus from a nozzle and pulls it back within the channel.
FIG. 4C shows partial top and side views of an example MEMS structure where increased backpressure pulls an ink meniscus back into a channel to expose a sensor plate to air drawn in through a nozzle.

FIGS. 4A, 4B, and 4C, show partial top and side views of an example MEMS structure in different stages as ink is retracted over the sensor plate during a fluid movement event, such as during ink drop ejections or an ink priming operation. As noted above, a fluid level sensor 206 generally includes elements of the MEMS structure such as a fluidic channel 210, a fluid chamber 204 and a dedicated sensor nozzle 116. A fluid level sensor 206 also includes an impedance measurement/sensor circuit 208 that incorporates a sensor plate 212 located within a fluidic channel 210, such as on the floor or on a wall of the fluidic channel 210. The impedance measurement/sensor circuit 208 operates to detect the degree to which fluid (ink) is present or absent within the fluidic channel during a fluid movement event such as an ink drop ejection or an ink priming operation. As the ink supply within a reservoir 120 nears its end of life, the backpressure exerted during printing or priming operations becomes strong enough to retract the ink meniscus from the nozzle 116 and back through the fluidic channel 210, exposing the sensor plate 212 to air. FIG. 4A shows a normal state where ink 400 fills the chamber 204 and forms an ink meniscus 402 within the nozzle 116. In this state, the sensor plate 212 is in a wet condition as it is covered with the ink that fills the fluidic channel 210. During a priming operation, or a normal ink drop ejection printing operation, a backpressure is exerted on the ink in the fluidic channel 210 which retracts the ink meniscus 402 from the nozzle and pulls it back within the channel as shown in FIG. 4B. As the ink supply in reservoir 120 nears its end of life, this backpressure increases, as does the time it takes for the ink to flow back into the channel 210 and nozzle 116. As shown in FIG. 4C, the increased backpressure pulls the ink meniscus far enough back into the channel 210 that the sensor plate 212 is exposed to air drawn in through nozzle 116. Depending on the amount of ink remaining in the reservoir and the resultant backpressure, the sensor plate 212 is exposed in greater or lesser amounts to air being drawn in through the nozzle 116. As discussed below, the sensor circuit 208 uses the exposed sensor plate 212 to determine an accurate ink level near the end of life of the ink supply.

Figure 5:
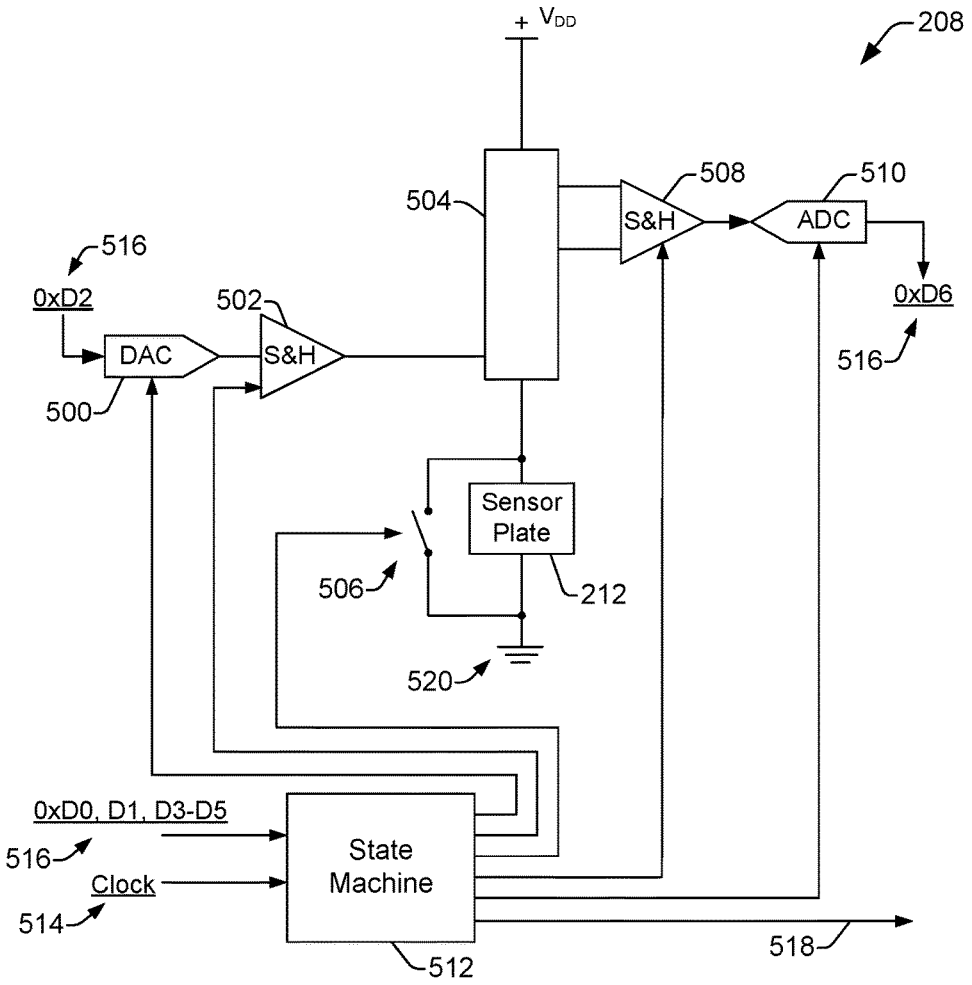
FIG. 5 shows a high level block diagram of an example impedance measurement/sensor circuit.
Figure 6:
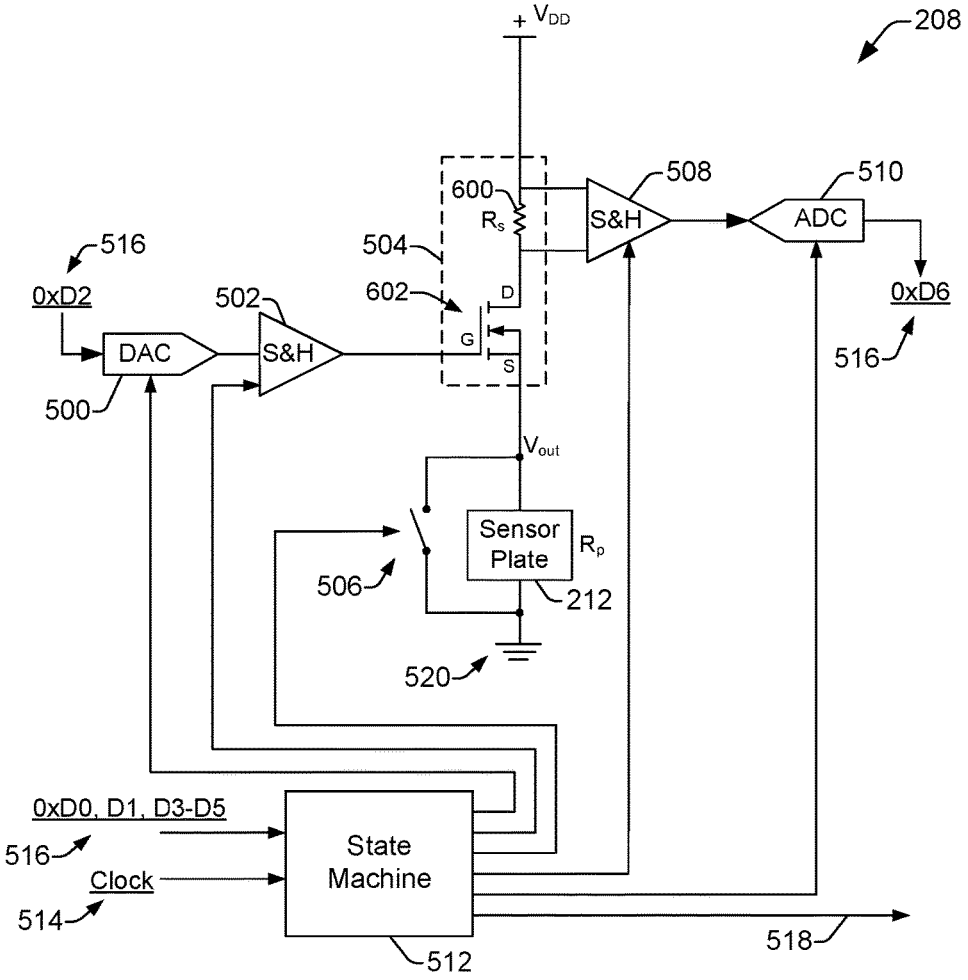
FIG. 6 shows a high level block diagram of an example impedance measurement/sensor circuit having a voltage source to induce current through a sensor plate.
Figure 7:
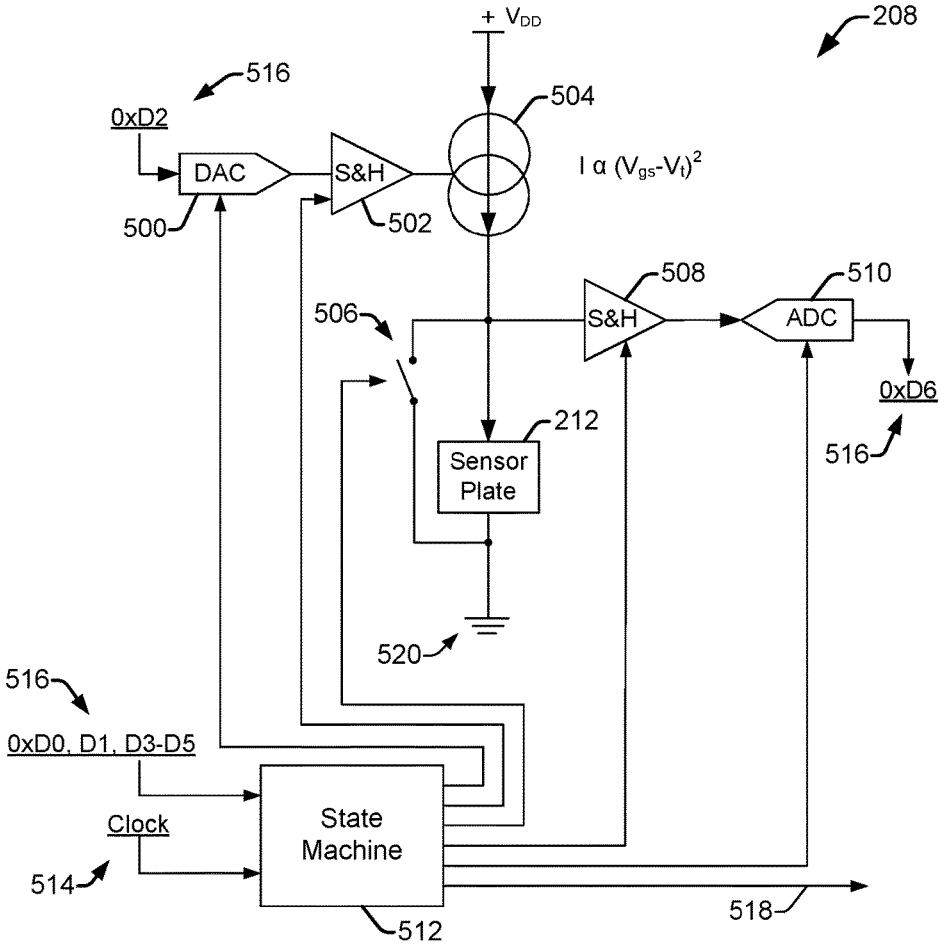
FIG. 7 shows a high level block diagram of an example impedance measurement/sensor circuit having a current source to induce voltage across a sensor plate.

FIG. 5 shows a high level block diagram of an example impedance measurement/sensor circuit 208. As noted above, an impedance measurement/sensor circuit 208 includes a sensor plate 212 located within a fluidic channel 210, and source components 504 to induce an impedance across the sensor plate 212. In one example, as shown in FIG. 6, source components 504 include a voltage source 504 coupled to the sensor plate 212 to induce a current through the plate 212 and a sense resistor 600. In this example, current passing through the sense resistor 600 is measured to determine impedance in the sensor plate 212. In another example, as shown in FIG. 7, source components 504 include a current source 504 coupled to the sensor plate 212 to induce a voltage across the sensor plate 212. In this example, voltage across the sensor plate 212 is measured to determine impedance in the sensor plate 212.

In addition to a sensor plate 212 and source components 504, an impedance measurement/sensor circuit 208 includes other components such as a DAC (digital-to-analog converter) 500, an input S&H (sample and hold element) 502, a switch 506, an output S&H 508, an ADC (analog-to-digital converter) 510, a state machine 512, a clock 514, and a number of registers such as registers 0xD0-0xD6, 516. Operation of the impedance measurement/sensor circuit 208 begins with configuring (i.e., biasing) the source components 504 with the DAC 500 and an input S&H 502 amplifier while switch 506 is closed to short out the sensor plate 212. The biasing algorithm 126, discussed in greater detail below, executes on controller 110 to determine a stimulus (input code) to apply to register 0xD2 that yields an optimum bias voltage from the DAC 500 with which to bias the source components 504.

After the source component 504 is biased, the measurement module 128 executes on controller 110 and initiates a fluid level measurement cycle during which it controls the impedance measurement circuit 208 through state machine 512. When it is time to measure, the state machine 512 coordinates the measurement by stepping the circuit 208 through several stages that prepare the circuit, take the measurements, and return the circuit to idle. In a first step, the state machine 512 initiates a fluid movement event, for example, by placing a signal on line 518. The fluid movement event spits or ejects ink from the nozzle 116 to clear the nozzle and chamber 204 of ink, and creates a backpressure spike in the fluidic channel 210. The state machine 512 then provides a delay period. The delay period is variable, but typically lasts on the order of between 2 and 32 microseconds.

After the delay period, a first circuit preparation step opens switch 506. Referring to FIG. 6, when switch 506 opens, the voltage source 504 is coupled to the sensor plate 212. The applied voltage source 504 induces a current through the plate 212 and through the sense resistor 600 according to an impedance in the ink covering the sensor plate 212. More specifically, the voltage across the plate 212, $V_{out}$, applied to the plate 212 is based on the relationship:

$$V_{out}=V_{dd}-I_D(R_s+R_p)$$

where $V_{dd}$ is the supply voltage and $I_D$ is the current through the drain of transistor controlled by the bias voltage from the DAC 500, $V_{gs}$ (i.e., the gate-to-source voltage of 602). The voltages in the circuit 208 are referenced to ground as shown at the ground symbol 520 in FIGS. 5-7. Referring to FIG. 7, when switch 506 opens, the current source 504 is coupled to the sensor plate 212 which applies current from the current source 504 to the plate 212. The current applied in to the impedance of the plate and the associated electrochemistry of ink on the plate (if ink is present), or air (if ink is not present), induces a voltage response across the plate and its chemical system. If the fluidic channel 210 is entirely dry, the impedance will be predominantly capacitive. If fluid is present, the impedance may be both real and imaginary time varying components. The current supplied from the current source 504 is based on the following relationship:

$$I\alpha(V_{gs}-V_t)^2$$

where Vgs is the bias voltage from the DAC 500. Vgs is the gate-to-source voltage and Vt is the gate threshold voltage of a current-producing transistor of the current source 504, onto which the DAC voltage is applied.

In a second circuit preparation step, the state machine 512 opens the switch 506 and provides a second delay period, which again lasts on the order of between 2 and 32 microseconds. After the second delay, the state machine 512 causes the output S&H amplifier 508 to sample (i.e., measure) an analog response. Referring to FIG. 6, the output S&H amplifier 508 samples the value of current flowing through sense resistor (Rs) 600 and holds the value. Referring to FIG. 7, the output S&H 508 samples the value of the voltage at the sensor plate 212 and holds the value. In both examples, the state machine 512 then initiates a conversion through ADC 510 that converts the sampled analog response value to a digital value that is stored in a register, 0xD6. The register holds the digital response value until the measurement module 128 reads the register. The circuit 208 is then put into an idle mode until another measurement cycle is initiated.

The measurement module 128 compares the digitized response value to an $R_{detect}$ threshold to determine if the sensor plate is in a dry condition. If the measured response exceeds the $R_{detect}$ threshold, then the dry condition is present. Otherwise the wet condition is present. (Calculation of the $R_{detect}$ threshold is discussed below). Detecting a dry condition indicates that the backpressure has pulled the ink in the fluidic channel 210 back far enough to expose the sensor plate 212 to air. Through additional measurement cycles, the length of time that the dry condition persists (i.e., while the sensor plate is exposed to air) is measured and used to interpolate the magnitude of backpressure creating the dry condition. Since the backpressure increases predictably toward the end of the life of the ink supply, an accurate determination of the ink level can then be made.

Figure 8:
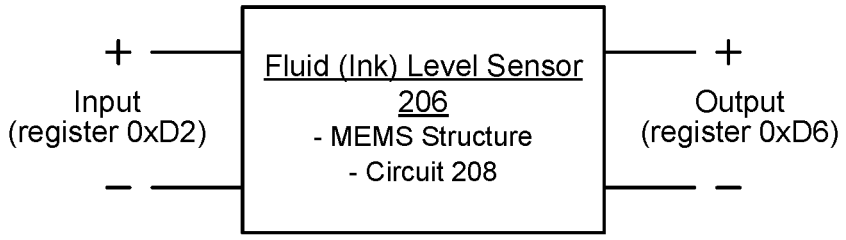
FIG. 8 shows an example of an ink level sensor as a black box element.

As noted above, the biasing algorithm 126 executes on controller 110 to determine an optimum bias voltage from the DAC 500 with which to bias the source components 504. The biasing algorithm 126 controls the fluid level sensor 206 (i.e., the impedance measurement circuit 208 and MEMS structure) while determining the bias voltage. From the perspective of the biasing algorithm 126, as shown in FIG. 8, the fluid level sensor 206 is a black box element that receives an input or stimulus and provides an output or response. An input voltage is set using a 0-255 (8-bit) number (input code) applied to register 0xD2 of the impedance measurement circuit 208. The input number or code in register 0xD2 is a stimulus that is applied to the DAC 500, and the analog voltage output from the DAC is the stimulus multiplied by 10 mV. Therefore, the range of analog bias voltage from the DAC 500 that is available for biasing the source components 504 is 0-2.55V. The output or response from the impedance measurement circuit 208 is a digital code stored in an 8-bit register 0xD6.

Figure 9:
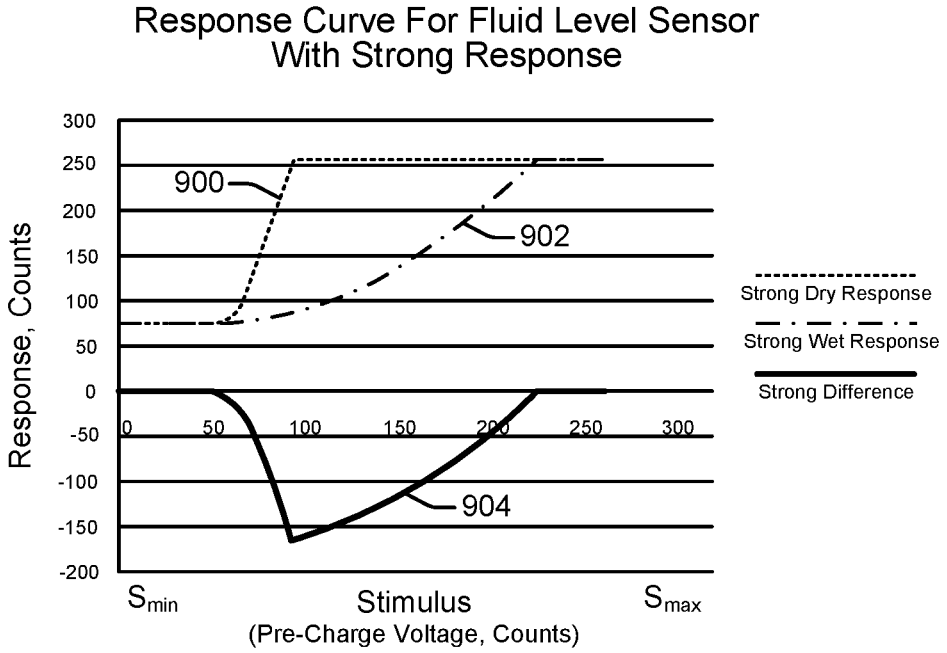
FIG. 9 shows examples of a dry response curve, a wet response curve, and a difference curve over a range of input stimulus.

The biasing algorithm uses the stimulus-response relationship of the impedance measurement circuit 208 between input codes and output codes to provide an optimum output delta signal (e.g., a maximum response voltage) between when the sensor plate 212 is wet (i.e., when ink is present in MEMS fluidic channel 210 and covers the plate) and when the sensor plate 212 is dry (i.e., when ink has been pulled out of the MEMS fluidic channel 210 and air surrounds the plate). As shown in FIG. 9, when the stimulus (input code) is swept from its minimum to its maximum pre-charge voltage count (i.e., 0-255; $S_{min}$ to $S_{max}$), the response (output code) generates response waveforms that progress through three distinct regions: Off, Active and Saturated. Together, the three regions form the shape of a lazy "S". FIG. 9 shows a dry response curve 900, a wet response curve 902, and a difference curve 904 that indicates the difference between the wet and dry response curves over the range of input stimulus. The FIG. 9 response curves depict favorable conditions where the responses are strong. In general, the largest signal delta (i.e., largest difference response curve) occurs between the case where the sensor plate 212 is fully wet with a full channel of ink, and the case where the sensor plate 212 is fully dry with full contact with air in the channel.

Figure 10:
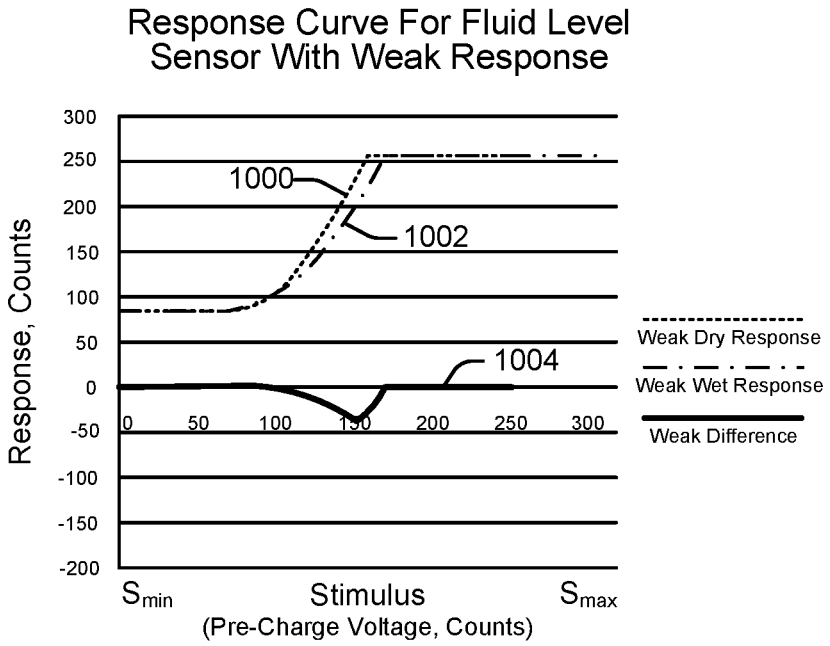
FIG. 10 shows examples of a weak dry response curve, a weak wet response curve, and a weak difference curve.

Although the response curves vary between the presence and absence of fluid/ink (i.e., between wet and dry conditions), the amount of variance is stronger when there is little or no contamination present in the MEMS structure, such as conductive debris and ink residue. Therefore, the response is initially strong as shown by the strong response curves in FIG. 9. However, over time the MEMS structure may become contaminated with ink residue in the fluidic channels and chambers, and the dry response in particular will degrade and become closer to the wet response. Contamination causes conduction in the dry case that makes the dry response weak, which results in a weak difference between the dry and wet response. FIG. 10 shows examples of weak dry 1000, wet 1002, and difference 1004 response curves where unfavorable conditions such as contamination in the MEMS structure have degraded the responses. As can be seen in FIG. 10, the difference between the weak wet and weak dry response curves is much less than the difference shown in the strong response curves of FIG. 9. The strong difference curve 904 shown in FIG. 9 provides a strong distinction between a wet and dry condition that can be readily evaluated. However, under weak response conditions, finding a distinction between wet and dry conditions is more challenging because of the weak difference. The biasing algorithm 126 finds the optimum point of difference in the weak response difference curve 1004 (i.e., shown in FIG. 10) where fluid/ink level measurements will provide the maximum response between wet and dry conditions.

Figure 11A:
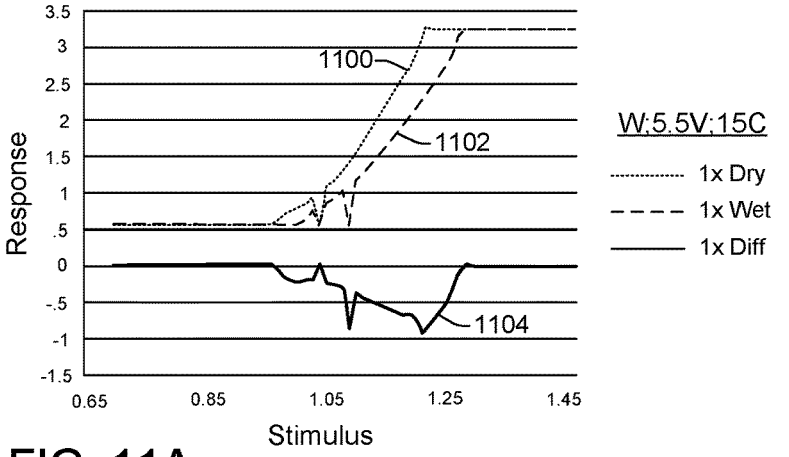
FIG. 11A shows examples of process and environmental variations in worst case processing conditions affecting weak wet and dry response curves over a 1× input stimulus range.
Figure 11B:
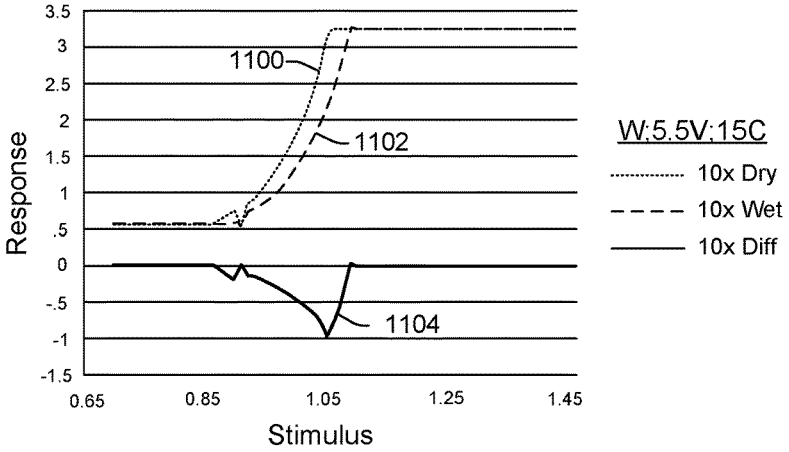
FIG. 11B shows examples of process and environmental variations in worst case processing conditions affecting weak wet and dry response curves over a 10× input stimulus range.
Figure 11C:
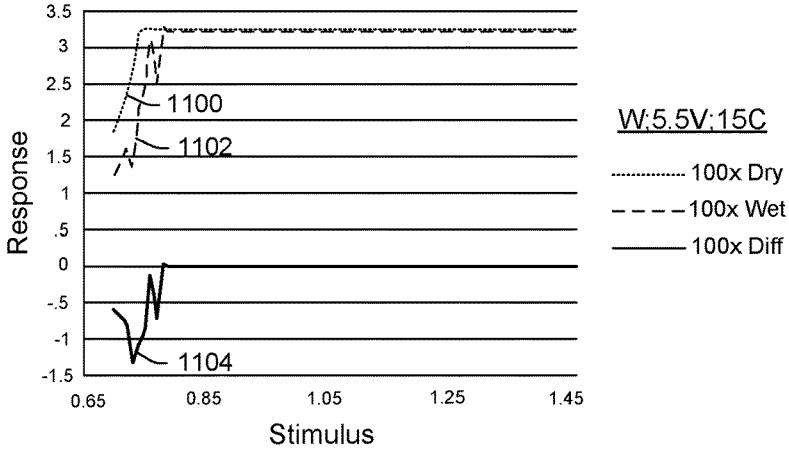
FIG. 11C shows examples of process and environmental variations in worst case processing conditions affecting weak wet and dry response curves over a 100× input stimulus range.
Figure 11D:
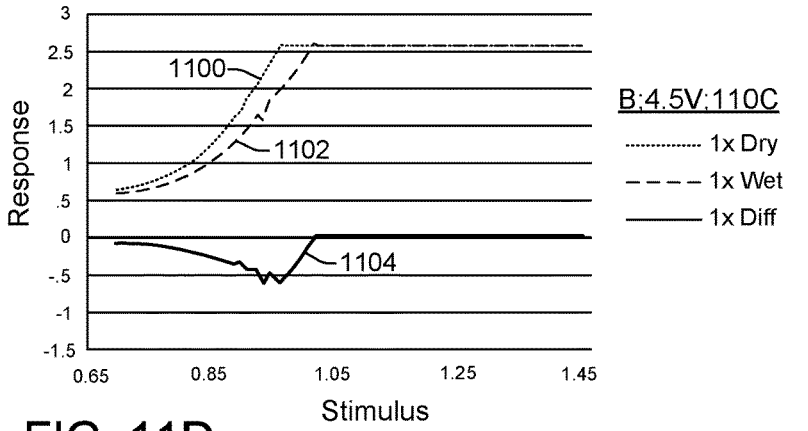
FIG. 11D shows examples of process and environmental variations in best case processing conditions affecting weak wet and dry response curves over a 1× input stimulus range.
Figure 11E:
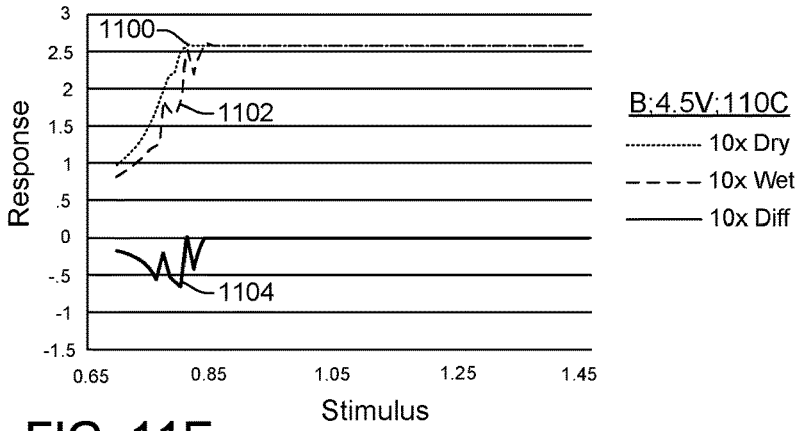
FIG. 11E shows examples of process and environmental variations in best case processing conditions affecting weak wet and dry response curves over a 10× input stimulus range.
Figure 11F:
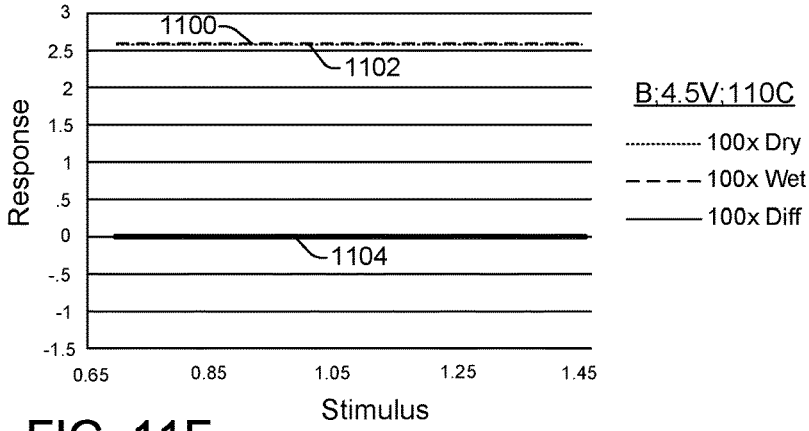
FIG. 11F shows examples of process and environmental variations in best case processing conditions affecting weak wet and dry response curves over a 100× input stimulus range.
Figure 11G:
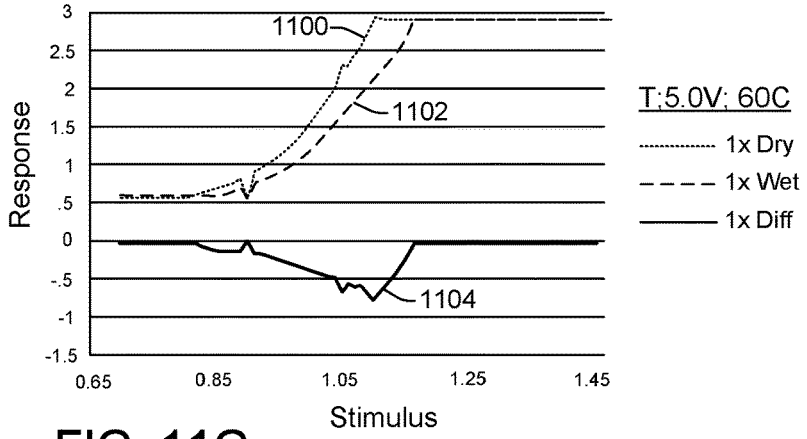
FIG. 11G shows examples of process and environmental variations in typical processing conditions affecting weak wet and dry response curves over a 1× input stimulus range.
Figure 11H:
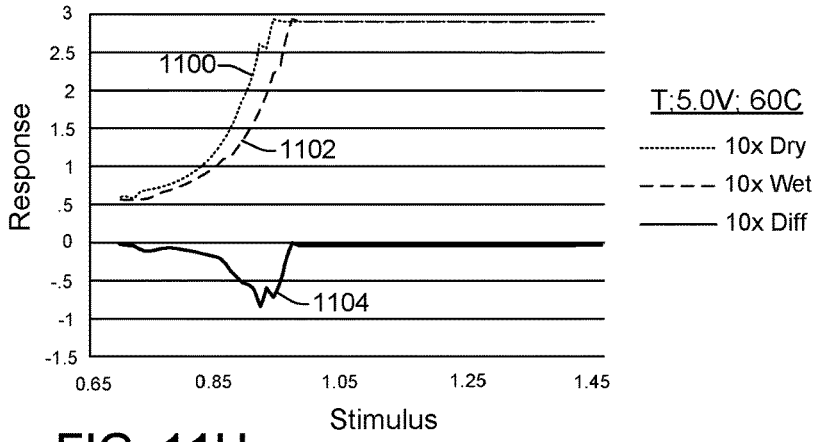
FIG. 11H shows examples of process and environmental variations in typical processing conditions affecting weak wet and dry response curves over a 10× input stimulus range.
Figure 11I:
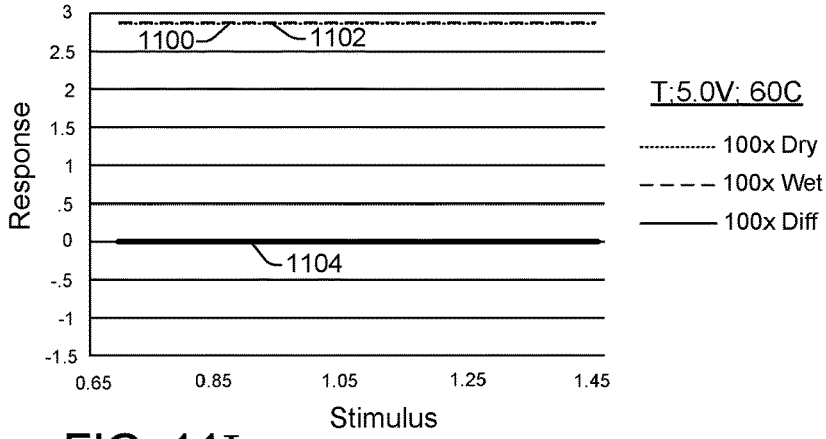
FIG. 11I shows examples of process and environmental variations in typical processing conditions affecting weak wet and dry response curves over a 100× input stimulus range.

FIGS. 11A, 11B, 11C, 11D, 11E, 11F, 11G, 11H, and 11I, show examples of weak dry response curves 1100 and weak wet response curves 1102 and their variations in response to differences in process and environmental conditions, such as manufacturing process, supply voltage and temperature (PV&T). FIGS. 11A, 11B, and 11C, show example curves over input stimulus ranges 1×, 10× and 100×, respectively, with worst (W) case processing conditions, a 5.5 volt supply, and 15 degrees centigrade temperature (referenced in FIGS. as "W; 5.5V; 15C"). FIGS. 11D, 11E, and 11F, show example curves over input stimulus ranges 1×, 10× and 100×, respectively, with best case (B) processing conditions, a 4.5 volt supply, and 110 degrees centigrade temperature (referenced in FIGS. as "B; 4.5V; 110C"). FIGS. 11G, 11H, and 11I, show example curves over input stimulus ranges 1×, 10× and 100×, respectively, with typical (T) processing conditions, a 5.0 volt supply, and 60 degrees centigrade temperature (referenced in FIGS. as "T; 5.0V; 60C"). In some cases, the active regions of the response curves change in slope due to variations in PV&T. In other cases, the active regions of the response curves shift their placement, starting earlier or later in the off region. The dry and wet response curves in FIGS. 11A, 11B, 11C, 11D, 11E, 11F, 11G, 11H, and 11I, show such variations in slopes and starting points that can result from varying PV&T conditions. The difference curves 1104 in FIGS. 11A, 11B, 11C, 11D, 11E, 11F, 11G, 11H, and 11I, show the difference between the wet and dry response curves over the range of input stimulus and over variations in PV&T conditions.

Figure 12:
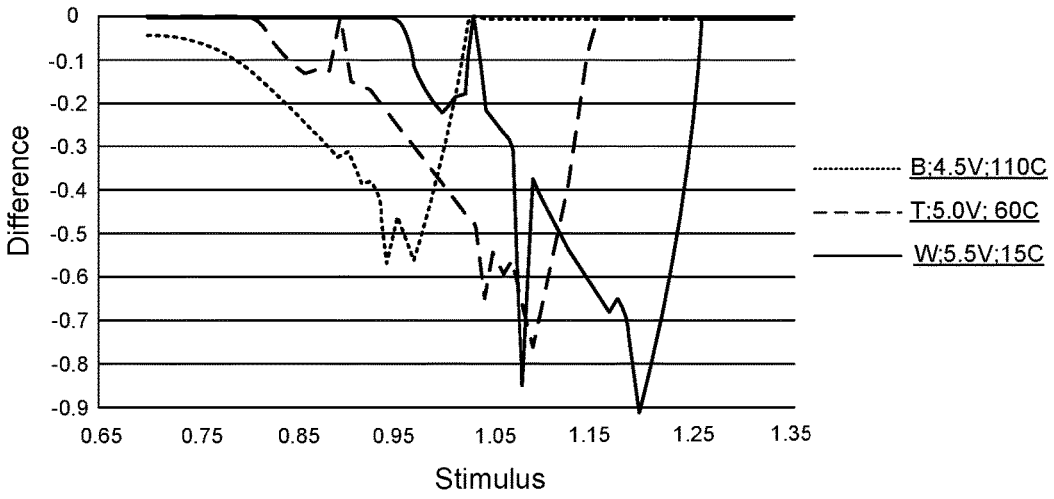
FIG. 12 overlays the wet-dry difference signals from FIG. 11 and shows the difference plotted against the stimulus, illustrating examples of shifts caused by process and environment.

FIG. 12 shows examples of the difference between the dry response and wet response plotted against the stimulus. The difference curves 1104 shown in FIG. 11 are overlaid to form FIG. 12. The intention is to illustrate that the height of the peak of the difference curves, the slope of the approach and decay of the curves, and the placement of the center of the stimulus axis along the curves, all vary across PV&T.

Figure 13:
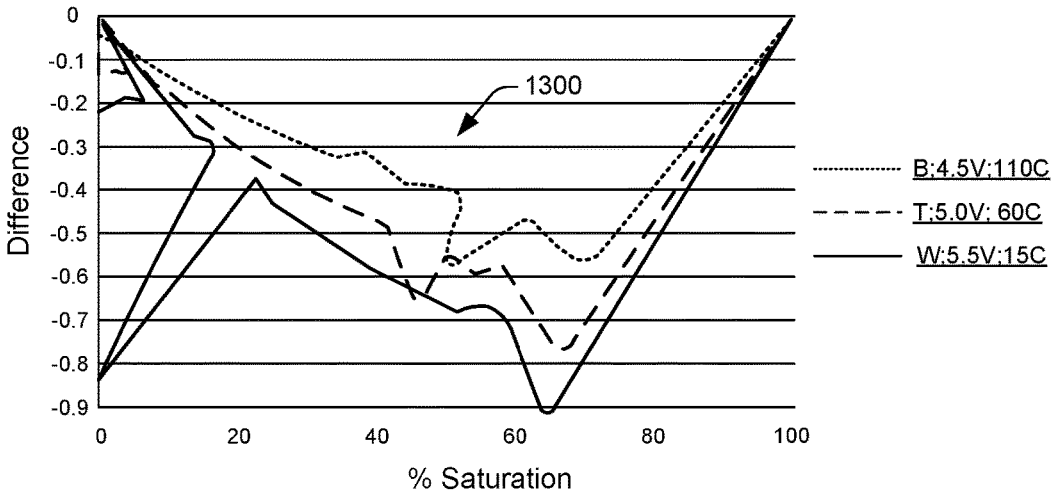
FIG. 13 shows examples of difference signal curves based on response instead of on stimulus.

FIG. 13 shows an example of composite difference curves 1300 plotted against the wet response, according to an embodiment of the disclosure. By shifting the basis of the difference curves to response, instead of stimulus, a measure of isolation from PV&T differences is achieved. The biasing algorithm 126 finds a solution where the optimum difference point is located in the weak difference case that provides a maximum ink level measurement response between wet and dry conditions. Therefore, the solution should be tolerant to such variations in PV&T, as well as provide as large a margin as possible. Accordingly, as shown in FIG. 13, a large amount of the PV&T variance can be removed by viewing the difference curve 1104 as a function of the wet response curve 1102, instead of as a function of the input stimulus. This is because there is a large variation in output value for a given stimulus over process, voltage and temperature (PV&T). However, the difference between the dry condition (no ink) and the wet condition (ink present) does not vary as much over PV&T, so using this difference subtracts off much of the PV&T-induced variation. The composite of the difference curves encompasses the area formed by overlaying many difference curves determined across all process and environmental (PV&T) conditions. Thus, the region above the composite difference represents viable signal response area that is independent of PV&T conditions. The center of the composite difference represents the location where ink level measurements should be made in order to achieve a peak response ($R_{peak}$) that maximizes the output response value (e.g., voltage response) between a dry condition and a wet condition. The location of the $R_{peak}$ response is expressed as a percentage of the span between the minimum and maximum wet response, $R_{min}$ and $R_{max}$. Thus, the location of $R_{peak}$ on the composite difference curve 1300 is called $R_{pd\ \%}$. In addition, during a measurement cycle, the height of the peak of the composite difference curve 1300 at location $R_{pd\ \%}$ represents the minimum difference expected (as a percentage of the span between $R_{min}$ and $R_{max}$) when the dry condition is present, and can be called $D_{min\ \%}$.

The biasing algorithm 126 determines an input stimulus value $S_{peak}$, that produces the peak response $R_{peak}$ located on the composite difference curve 1300 at Rpd %. The algorithm inputs a minimum stimulus ($S_{min}$) at register 0xD2 and samples the response in register 0xD6. The algorithm also inputs a maximum stimulus ($S_{max}$) at register 0xD2 and samples the response in register 0xD6. These two values in register 0xD6 are the extremes of response, $R_{min}$ and $R_{max}$ respectively. The peak response value $R_{peak}$ can then be calculated as follows:

$$R_{peak}=R_{min}(R_{pd\ \%}*(R_{max}-R_{min}))$$

The corresponding stimulus value, $S_{peak}$, can then be found by a variety of approaches. The stimulus can, for example, be swept from $S_{min}$ to $S_{max}$, stopping when the response reaches $R_{peak}$. Another approach is to use a binary search. The stimulus value $S_{peak}$ that produces the peak response $R_{peak}$ is the input code applied to register 0xD2 to optimally bias the source components 504 in the impedance measurement circuit 208 such that a maximum response can be measured across the sensor plate 212 between a dry plate condition and a wet plate condition.

As noted above, in a measurement cycle the measurement module 128 can determine if the sensor plate 212 is in a dry condition by comparing the response voltage measured across the plate to an $R_{detect}$ threshold. If the measured response exceeds $R_{detect}$ then the dry condition is present. Otherwise the wet condition is present. The $R_{detect}$ threshold is calculated by the following equation:

$$R_{detect}=R_{peak}+((R_{max}-R_{min})*(D_{min\ \%}/2))$$

The minimum difference $D_{min\ \%}$ expected in the response voltage is split (i.e., divided by 2) to share the noise margin between the dry condition case and the wet condition case.

What is claimed is:

1. A fluid ejection device comprising:

a sensor plate located within a fluidic channel;

a source component to induce impedance across the sensor plate; and, an output sample and hold element to measure an analog response in the sensor plate associated with a fluid movement event within the fluidic channel, the analog response indicating an impedance value across the sensor plate.

2. A fluid ejection device as in claim 1, wherein the source component comprises one of, a voltage source wherein the output sample and hold element is to measure current flow through the sensor plate, and a current source wherein the output sample and hold element is to measure voltage across the sensor plate.

3. A fluid ejection device as in claim 1, further comprising:

a switch across the sensor plate; and, a digital to analog converter and an input sample and hold element to bias the source component while the switch is in a closed position that shorts the sensor plate to ground.

4. A fluid ejection device as in claim 3, further comprising:

a state machine to initiate the fluid movement event, control the switch, cause the output sample and hold element to sample the analog response, and initiate a conversion through an output analog to digital converter of the analog response to a digital value for subsequent comparison with a threshold to determine if the sensor plate is in a wet condition or a dry condition.

* * * * *